US005542129A

United States Patent [19]

Munoz

[11] Patent Number: 5,542,129

[45] Date of Patent: Aug. 6, 1996

[54] CONVERTIBLE HAT AND CATCHING GLOVE

[76] Inventor: Douglas G. Munoz, 9 W. Belvidere St., St. Paul, Minn. 55107

[21] Appl. No.: 89,079

[22] Filed: Jul. 8, 1993

[51] Int. Cl.[6] ..... A42B 1/04

[52] U.S. Cl. ..... 2/209.12; 2/19; 2/195.1

[58] Field of Search ..... 2/19, 161 A, 171, 2/175, 185 R, 195, 196, 199, 209.1, 159, 160, 161.1, 209.11, 209.12

[56] References Cited

U.S. PATENT DOCUMENTS 4,268,918 5/1981 Lee ..... 2/199
4,628,543 12/1986 Hunt ..... 2/196
4,768,232 9/1988 Villalobos ..... 2/196055421382
4,829,600 5/1989 Courtney ..... 2/196

*Primary Examiner*—Clifford D. Crowder
*Assistant Examiner*—Diana L. Biefeld

[57] ABSTRACT

A hat or cap having a concave crown formed by joining panels including two side panels and a top panel. A finger panel is disposed within the crown adjacent the top panel and connected to the crown to form a finger pocket. At least one thumb panel is disposed outside the crown, adjacent one of the side panels, and connected to the crown to form a thumb pocket. The finger pocket and the thumb pocket define a glove.

10 Claims, 2 Drawing Sheets

CONVERTIBLE HAT AND CATCHING GLOVE

BACKGROUND OF THE INVENTION

The present invention pertains generally to a hat or cap which also can serve as a catching glove.

Hats or caps which can also be used as catching gloves offer unique advantages not available with traditional caps or gloves. Such caps can be worn by spectators at baseball games and other athletic events. The caps offer the advantages provided by hats generally, for example, protecting the wearer's head and face from the sun. These caps, however, offer the additional advantage that the wearer can remove the cap from the wearer's head and use the cap as a catching glove or mitt. This feature is particularly advantageous when the wearer is a spectator at a baseball game and a foul or fly ball is hit into the stands where the wearer can use the cap as a glove to attempt to catch the ball.

Prior caps used as gloves are known. One is that disclosed by Villalobos in U.S. Pat. No. 4,768,232 which generally includes a conventional baseball cap having a crown and a forwardly disposed brim. A patch is attached to the fore portion of the crown proximate the brim to form a pocket or glove disposed on the forward portion of the crown. An opening for inserting the wearer's hand is located proximate the brim.

The prior cap disclosed by Villalobos is a novelty cap. That is, the Villalobos cap looks like a cap with a glove mounted on it. Further, the proximity of the brim to the opening of the Villalobos glove requires that the brim be moved out of the way in order to put the wearer's hand into the glove. This obstacle becomes particularly troublesome when the wearer is attempting to put the glove on quickly in order to catch a ball hit into the stands.

SUMMARY OF THE INVENTION

The present invention provides a convertible hat or cap and catching glove that retains the appearance of a conventional hat or cap. The wearer can quickly remove the hat from the head and insert a hand to use the hat as a glove. The present invention is particularly useful when the wearer is a spectator at a baseball game and is using the hat as a glove to catch a foul or fly ball hit into the stands.

A hat in accordance with the present invention provides a convertible hat or cap and catching glove with the look of a generally conventional baseball hat or cap. The hat can be made to suggest the look of a traditional baseball glove if that is desired.

The convertible hat and catching glove of the present invention includes a crown formed by joining panels, including two oppositely disposed side panels and a top panel. A finger panel is disposed within the crown adjacent the top panel. The finger panel is connected to the crown forming a finger pocket. At least one thumb panel is disposed outside the crown, adjacent one of the side panels. The thumb panel is connected to the crown forming a thumb pocket. The finger and thumb pocket together define a glove.

In one embodiment of the invention, the top panel has two oppositely disposed edges. A brim extends from a forward edge of the crown. Two thumb panels are disposed outside the crown proximate the oppositely disposed side panels. Each thumb panel has a top edge and a bottom edge. The bottom edge of each thumb panel is connected to opposite side panels.

The hat also includes two forwardly disposed means connecting the top panel, the side panel, and the finger panel proximate forward portions of the oppositely disposed edges of the top panel to form a finger pocket between the finger panel and the top panel. Two rearwardly disposed means connecting the top edge of each thumb panel to a rearward portion of each edge of the top panel to form two thumb pockets between the thumb panels and the side panels.

The rearwardly disposed means also forms a palm pocket between the finger panel and the top panel. The palm pocket is a rearward extension of the finger pocket wherein the two rearwardly disposed means are separated apart from the finger panel and the side panels. The separation defines a gap between each rearwardly disposed means and the finger panel and inside panels. This gap allows communication between the palm pocket and the thumb pocket so that either a left hand or right hand can be inserted into a glove defined by the finger pocket, the thumb pocket and the palm pocket.

The cap can include fasteners for fastening the finger panel to the top panel between and approximately parallel the oppositely disposed edges of the top panel. This divides the finger pocket into at least two smaller pockets for inserting at least one finger in each pocket.

The area inside the crown proximate the finger panel may be padded to protect the wearer's hand from injury while catching a baseball or other object. Alternately, the finger panel may be a layered composite having at least one foam padding layer.

DETAILED DESCRIPTION OF THE PREFERRED EMBODIMENTS

Figure 1:
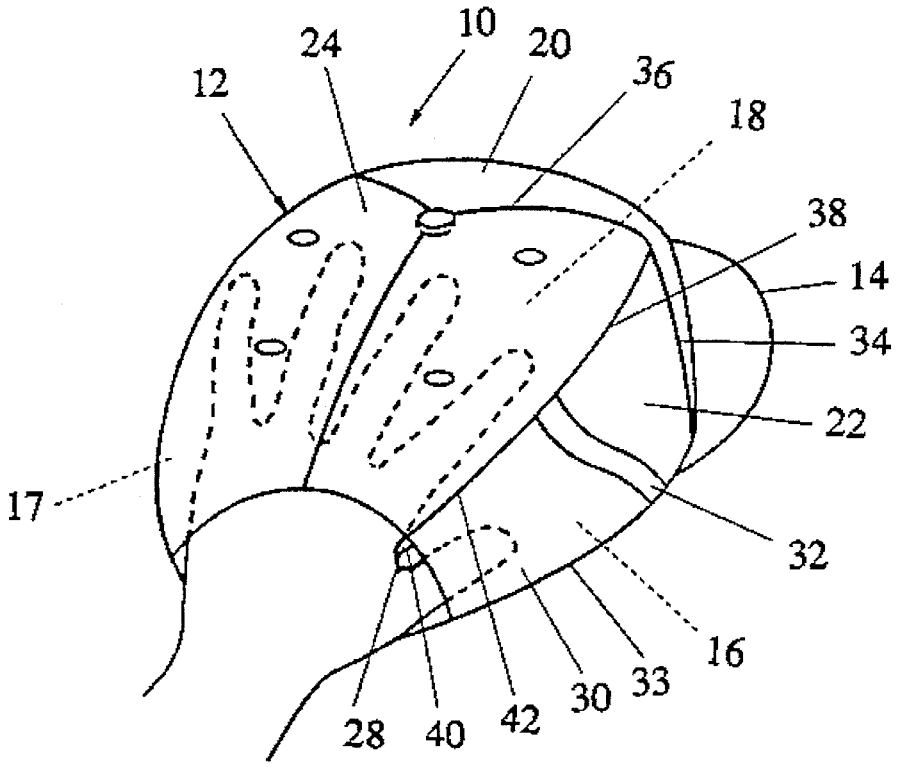
FIG. 1 shows a perspective view of a hat or cap in accordance with the present invention having a wearer's hand partially inserted therein.

Referring now to the drawings wherein like reference numerals designate like elements throughout the several views, FIG. 1 shows a hat or cap in accordance with the present invention generally referred to by the numeral 10. It is anticipated that many types of hats can be made in accordance with the present invention, however, the preferred hat is a cap, such as a baseball cap. Hat 10 preferably has a crown 12 and a brim 14 or visor extending forward from a forward portion of the crown. A wearers hand A is shown partially inserted into a thumb pocket 16, a palm pocket 17 and a finger pocket 18 of hat 10.

The present invention offers the advantages of providing a hat or cap which the wearer can quickly remove from the wearer's head and insert the wearer's hand into the cap for use as a glove. This feature is particularly useful to the wearer when the wearer is a spectator at a baseball game. As a spectator, the wearer can use the glove to catch a foul or fly ball hit into the spectator stands. The present invention also provides a hat with the look of a conventional baseball cap.

Concave crown 12 of hat 10 is preferably constructed from a plurality of flexible fabric panels. Each panel may be formed from a single piece of fabric or formed by piecing together several pieces of fabric as well known in the art. The fabric is preferably a cotton or nylon cloth, however, leather or other similarly flexible materials may be used to form the panels.

Figure 2:
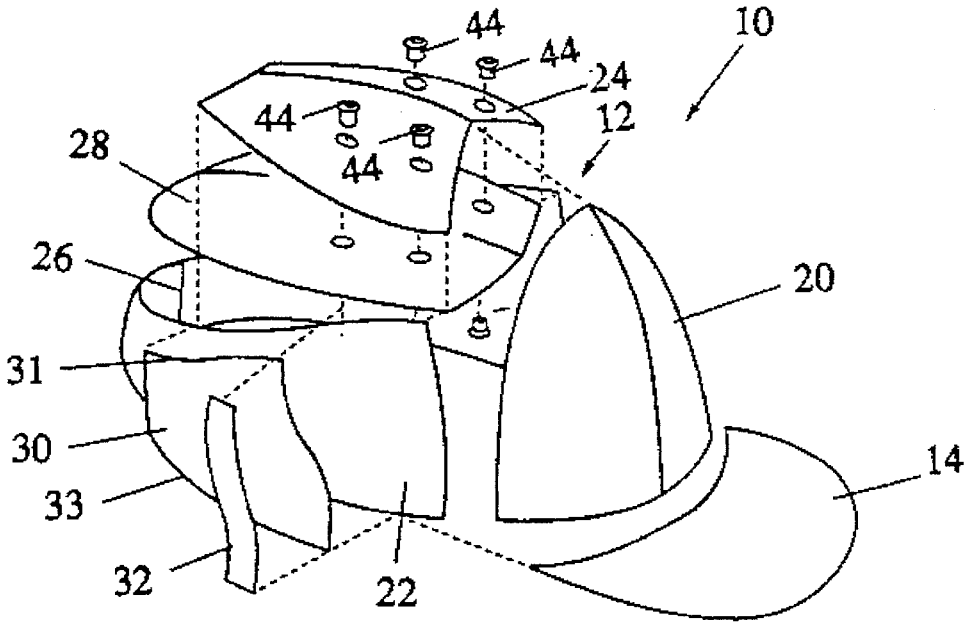
FIG. 2 shows an exploded view of the hat shown in FIG. 1.

As shown in FIGS. 1 and 2, one embodiment of the crown 12 of hat 10 includes a front panel 20, two oppositely disposed side panels 22 and a top panel 24 having two oppositely disposed edges. Side panels 22 may be fastened to each other rearwardly opposite front panel 20 along a sewn seam 26. Alternately, side panels 22 could be attached to each other using a conventional adjustable fastener (such as snaps or hook and loop) to allow the hat to be fitted to several sizes as is well known in the art. The remaining connections of the panels and brim one to another, can be accomplished by sewing or gluing the panels together or by any other means generally known or used in the art.

In the preferred embodiment, hat 10 also includes a finger panel 28 and at least one thumb panel 30 having a top edge and a bottom edge. An optional decorative panel 32 may also be used. Preferably, although not visible in FIGS. 1 or 2, one thumb panel 30 and decorative panel 32 is disposed in approximately mirror image position proximate each oppositely disposed side panel 22.

Preferably side panels 22 are connected to opposite sides of front panel 20 along seams 34. Top panel 24 is preferably connected to front panel 20 along seam 36. Side panels 22, top panel 24 and finger panel 28 are preferably connected along two oppositely disposed seams or forwardly disposed means 38. Rearward of means 38, side panels 22 are connected to finger panel 28 along a seam 40. Top panel 24 is preferably connected to thumb panel 30 proximate top edge 31 along a seam or rearwardly disposed means 42. Decorative panels 32 are preferably fastened to crown 12 proximate forward edges of thumb panels 30. Brim 14 is fastened to crown 12 proximate a peripheral edge of crown 12 and front panel 20.

By connecting side panels 22 to top panel 24 and finger panel 28 along oppositely disposed means 38, finger pocket 18 is formed between top panel 24 and finger panel 28. A fastener for fastening the finger panel to the top panel approximately parallel oppositely disposed edges of top panel 24 can serve to subdivide finger pocket 18 into smaller pockets for insertion of one or more fingers. The fastener for fastening the finger panel to the top panel may include rivets 44 as shown in FIG. 2. The fastener for fastening the finger panel to the top panel could also include a sewn seam or any other means for fastening known in the art.

Connecting thumb panels 30 to side panels 22 proximate bottom edges 33, and connecting top panel 24 to thumb panels 30 along rearwardly disposed means 42 forms oppositely disposed thumb pockets 16 and palm pocket 17. Preferably rearwardly disposed means 42 are separate from finger panel 28 and side panels 22. This separation forms a gap between each rearwardly disposed means 42 and finger panel 28 and side panels 22. The gap allows communication between palm pocket 17 and thumb pockets 16. Since the panels are preferably made from a flexible fabric, it is anticipated that the gap may collapse during normal use, but will be opened each time the wearer's hand is inserted into hat 10.

In one embodiment of the invention, the area inside crown 12 proximate finger panel 28 is padded. This padding might, for example, include a finger panel 28 being fabricated from a layered composite having at least one layer of foam padding.

Figure 3:
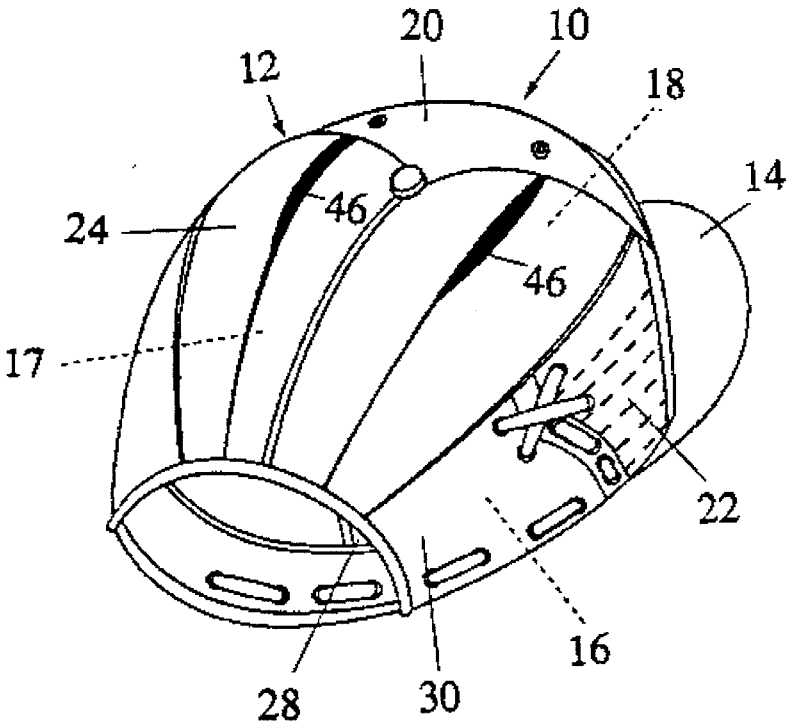
FIG. 3 shows a perspective view of an alternate embodiment of a hat in accordance with the present invention.
Figure 4:
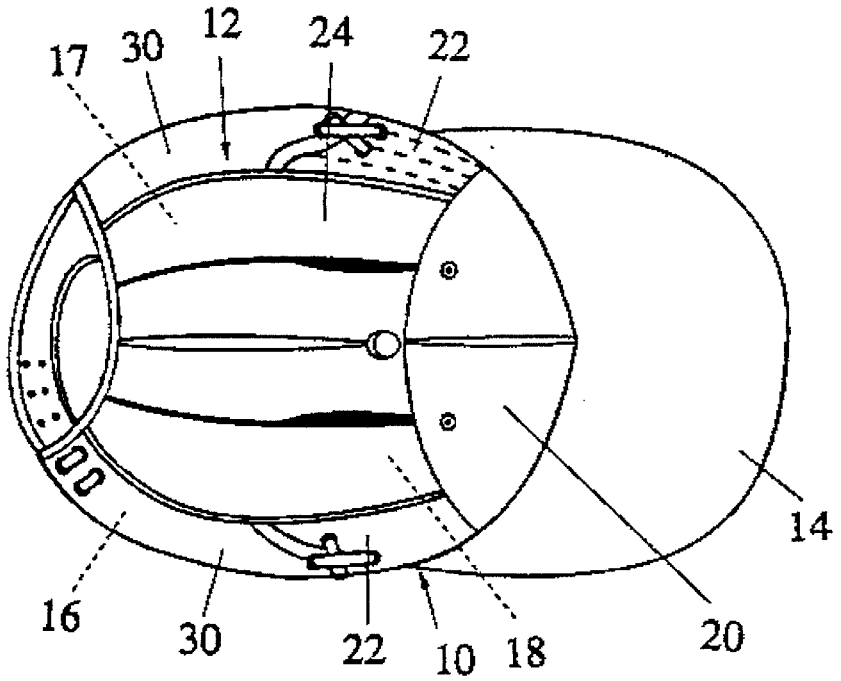
FIG. 4 shows a top view of the alternate embodiment of the hat shown in FIG. 3.

FIGS. 3 and 4 show an alternate embodiment 10' of the hat or cap in accordance with the present invention. Alternate embodiment 10' is functionally and structurally essentially similar to hat 10. The exterior of alternate embodiment 10' has been fashioned to suggest the look of a traditional baseball fielders glove.

Like embodiment 10, embodiment 10' has a crown 12' and a forwardly disposed brim 14'. Embodiment 10' also includes at least one thumb pocket 16', palm pocket 17', and the finger pocket 18'. Like embodiment 10, embodiment 10' also includes a front panel 20' two oppositely disposed side panels 22', a top panel 24', a finger panel 28' and at least one thumb panel 30'. The panels of embodiment 10' are connected in accordance with the description above for embodiment 10. In embodiment 10', stitching 46 rather than rivets 44 is used to subdivide finger pocket 18' into smaller pockets.

In use, hat 10 of the present invention can be worn as a typical hat for protecting the wearer's head and face from the sun and weather, or as a fashion accessory. Hat 10, however, is convertible for use as a catching glove or mitt by the wearer.

To use hat 10 as a glove, the wearer inserts the wearer's fingers into finger pocket 18 between top panel 24 and finger panel 28. The wearer inserts wearer's thumb into thumb pocket 16 between side panel 22 and thumb panel 30. Since a gap exists between rearwardly disposed means 42 and side panels 22 and finger panel 28, the wearer can insert the wearer's fingers and thumb deep enough into finger pocket 18 and thumb pocket 16 respectively, so that wearer's palm is in palm pocket 17.

Once the wearer's hand is inserted into hat 10 the wearer is ready to catch baseballs or other objects inside the concave portion of crown 12. It is anticipated that brim 14 may assist the wearer in catching by extending the wearer's reach.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. In a hat or cap having a concave crown formed by joined panels, the crown including sides and a top, the improvement comprising:

a finger panel disposed within the crown adjacent the top, the finger panel being connected to the crown to form a finger pocket;

at least one thumb panel disposed outside the crown adjacent one of the sides, the thumb panel being connected to the crown to form a thumb pocket, wherein the finger pocket and the thumb pocket form a glove.

2. A hat or cap, in accordance with claim 1, further comprising means for fastening the finger panel to the crown top and dividing the finger pocket into two or more smaller pockets, each smaller pocket accepting at least one finger.

3. A hat or cap, in accordance with claim 1, wherein the finger panel is padded.

4. A hat or cap, in accordance with claim 1, wherein the finger panel is a layered composite having at least one foam padding layer.

5. A hat or cap, in accordance with claim 1, wherein the crown has a peripheral edge, the hat further comprising a brim operably connected to the peripheral edge of the crown.

6. In a hat or cap having a concave crown including a top panel having two oppositely disposed edges and two side panels, the improvement for forming a catching glove comprising:

a finger panel disposed within the crown adjacent the top panel;

at least one thumb panel disposed outside the crown adjacent a side panel, the thumb panel having a bottom edge connected to the side panel and a top edge;

means connecting the top panel, the side panel and the finger panel proximate a forward portion of the oppositely disposed edges of the top panel to form a finger pocket; and means connecting the thumb panel to a rearward portion of the edge of the top panel to form a thumb pocket disposed proximate the side panel and a palm pocket, the palm pocket being a rearward extension the finger pocket.

7. A hat or cap, in accordance with claim 6, further comprising means for fastening the finger panel to the top panel between and approximately parallel the oppositely disposed edges of the top panel while dividing the finger pocket into at least two smaller pockets, each smaller pocket being for insertion of at least one finger.

8. A hat or cap, in accordance with claim 6, further comprising means for padding the finger panel.

9. A hat or cap, in accordance with claim 6, wherein the finger panel is a layered composite having at least one foam padding layer.

10. A hat or cap, in accordance with claim 6, wherein the crown has a peripheral edge, the hat further comprising a brim operably connected to the peripheral edge of the crown.

* * * * *